United States Patent [19]

Mueller et al.

[11] 3,949,852

[45] Apr. 13, 1976

[54] TYPEBAR SUPPORT

[75] Inventors: Hans W. Mueller; Richard E. Shattuck, both of Cortland, N.Y.

[73] Assignee: SCM Corporation, New York, N.Y.

[22] Filed: July 31, 1974

[21] Appl. No.: 493,379

[52] U.S. Cl. ..... 197/42
[51] Int. Cl.[2] ..... B41J 7/30
[58] Field of Search ..... 197/42

[56] References Cited

UNITED STATES PATENTS

| | | | |
|---|---|---|---|
| 989,591 | 4/1911 | Felbel | 197/42 |
| 3,042,176 | 7/1962 | Brann | 197/42 |
| 3,368,659 | 2/1968 | Mumpower | 197/42 |

*Primary Examiner*—Paul E. Shapiro
*Attorney, Agent, or Firm*—Stanley J. Klem; Milton M. Wolson

[57] ABSTRACT

A typebar support for low cost typewriters includes an arcuate segment supported on a frame where a plurality of typebars are pivotally mounted. The free ends of the typebars are supported by an arcuate support. The support is rockably suspended on the frame by a pair of arms extending from the ends of the support to the frame. The arms are biased upward by a pair of springs and limited in its upward movement by an abutment mounted on the segment. As a typebar returns to rest after a print cycle has been completed, the energy accumulated in the typebar during flight is partially dissipated when it impacts on a yieldable pad on the typebar receiving edge of the support. The remaining energy is absorbed by the rocking motion of the support. The energy dissipation by the yieldable pad combined with the energy absorption by the rockable support results in a typebar support that effectively reduces typebar rebound and the accompanying problems.

5 Claims, 4 Drawing Figures

TYPEBAR SUPPORT

BACKGROUND OF THE INVENTION

Rebounding typebars have always been a problem in the typewriter industry and the problem is more acute with electric typewriters which generally are operated at high speed. This problem is even more acute when a low cost typebar mechanism is utilized. Low cost typebar mechanisms generally do not lock in the rest position. In other words, any typebar may freely rebound from its rest position. Therefore, a returning typebar may easily rebound into the flight path of another typebar. Unless the energy of a returning typebar is substantially dissipated the moment it strikes the typebar support, the typebar is likely to rebound. If the typebar rebound is great, the typebar may collide with an adjacent typebar that is already in flight towards a printing point on a work sheet.

Collision of the typebars has been known to cause damage to the typebar parts and reduce the driving speed and impact force of the typebar. Variations in the impact force of individual typebars causes undesirable non-uniform type density and line of write.

If a typebar is in the repeat action mode or rapid typing is in process, and the typebar rebounds too high, it may not return to its rest position on the typebar support. If this occurs and a subsequent typing action begins, the driving force of the subsequent typing action is adversely affected. Consequently, the density of the printed character may be too light or too dark or the subsequent typebar may not engage the driving means properly and result in a non-print.

Improvements in the design of the typebar support have resulted in many designs that incorporated yieldable typebar receiving members.

One such design as shown in U.S. Pat. No. 3,384,217 to C. P. Anderson incorporates a fixed arcuate frame rigidly mounted to a typebar segment and includes a yieldable strip positioned in a slit in the arcuate frame. The yieldable strip is sandwiched between the frame and a rigid strip. An extension spring disposed along the length of the arcuate frame biases the yieldable strip radially inward. When a typebar returns to rest, the energy accumulated in the typebar during flight is absorbed and dissipated by the yieldable structure of the arcuate frame of the typebar support.

Another such design as shown in U.S. Pat. No. 2,903,119 to A. D'Onofrio, et al, includes a pair of arcuate interconnected elements pivotally supported on a pair of arms that are rigidly mounted to a frame. As a typebar returns to rest, it initially strikes the first element and then the second element. The energy accumulated in the typebar during flight is partially dissipated as the typebar strikes the first element and thereafter progressively absorbed until it strikes the second element at which time the typebar energy is fully dissipated.

A third such design as shown in U.S. Pat. No. 3,554,336, includes a thick plastic tape suspended at its ends by leaf springs and pins to provide a support for the typebars at rest. As a center typebar returns to rest on the support, it deforms the plastic tape and also twists the leaf springs. Therefore, the relative movement of the typebar support in relation to the typebars is increased and the attenuating effect of the typebar support is improved.

The typebar supports of the prior art all include arcuate yieldable members supported by rigid arms. This construction is costly in that a complicated structure is required to make the arcuate member yieldable. Furthermore, the total energy of the returning typebars in the prior art is absorbed in the arcuate member and not the entire support structure.

The present invention is an improvement over the typebar supports of the prior art in that the mounting of the typebar support and most of the yielding of the typebar support occur about one common point. The foregoing prior art structures do not provide a structure that is mounted and yields about a common point.

In other words, the present invention includes a rigid arcuate member with a yieldable pad mounted thereon. The arcuate member is supported by rigid arms that are rockably mounted to the frame.

The mounting and the the rocking of the typebar support about a common point allows for a less costly construction in that the portion of the typebar support on which the typebars rest does not require any complicated structure for yielding.

The energy of the returning typebar in the present invention is partially dissipated in the yeildable pad on the typebar support. The greatest amount of energy is dissipated when the entire support structure including the support arms is urged to rock as the typebars impact the support. Dissipating the energy of the returning typebars throughout the entire support structure including the support arms allows a more economical, efficient and a simplified construction to be used.

SUMMARY OF THE INVENTION

The present invention provides a typebar support that is rockably suspended on a frame to prevent typebar rebound by dissipating and absorbing the energy of typebars returning to rest. The typebar support is an arcuate shaped member that is rockably suspended in relation to a fixed member. The typebars are pivotally anchored in the segment on the typebar support intermediate their ends. The typebar support is supported at each end by an arm that is rockably mounted to a frame. A yieldable pad covers the receiving edge of the typebar support. The rockably suspended typebar support is spring biased upward against an abutment fixed to the segment. As the typebar returns to rest on the support, a portion of its kinetic energy is dissipated upon contact with the yieldable pad. The remaining portion of the energy is dissipated and absorbed as the entire support rocks on the loosely supported arms.

Accordingly, it is an object of the present invention to provide a yieldable typebar support to dissipate and absorb the kinetic energy of in-flight typebars as they return to rest on the typebar support.

It is a further object of the present invention to provide a typebar support of simple construction.

It is another object of the present invention to provide a typebar support that is rockably supported on a frame relative to a typebar segment.

Other objects, features, and advantages of the invention will become more apparent from the following description, including appended claims, and accompanying drawings, in which:

DESCRIPTION OF THE PREFERRED EMBODIMENT

Figure 1:
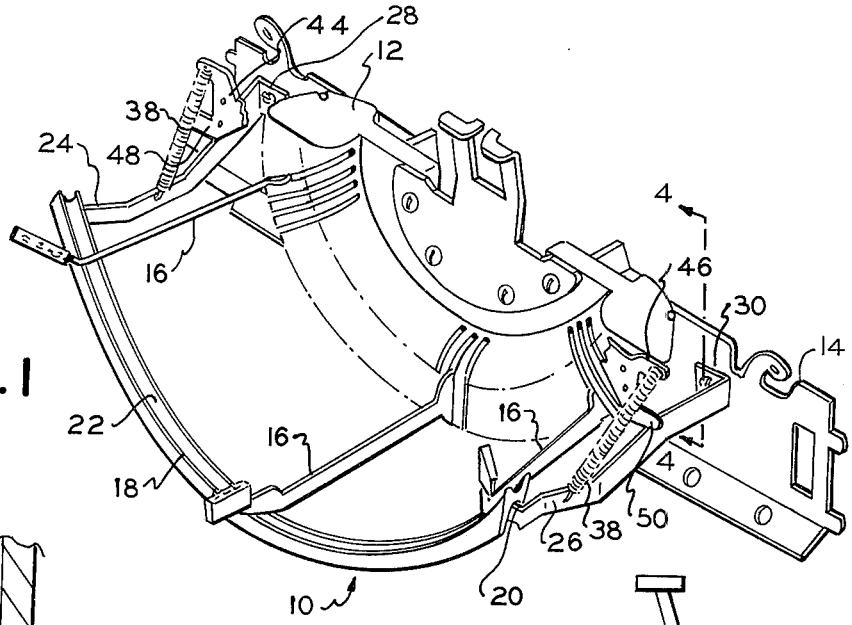
FIG. 1 is a perspective view of the typebar support of the present invention.

Referring now to FIG. 1 showing a typebar support 10 in relation to a typebar segment 12 that is rigidly mounted to a frame 14. Normally a full compliment of typebars are pivotally anchored in segment 12, but for purposes of clarity, only a few typebars 16 are shown.

Figure 4:
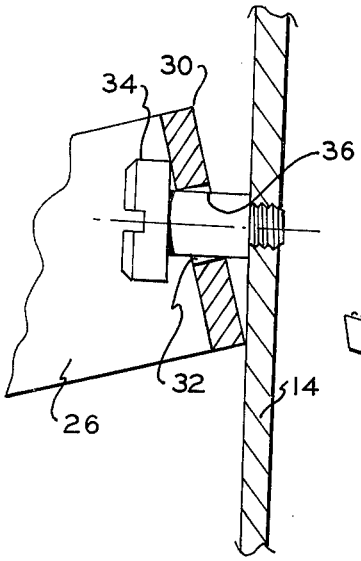
FIG. 4 is an enlarged section view showing a portion of the typebar support rocked about its mounting.
Figure 2:
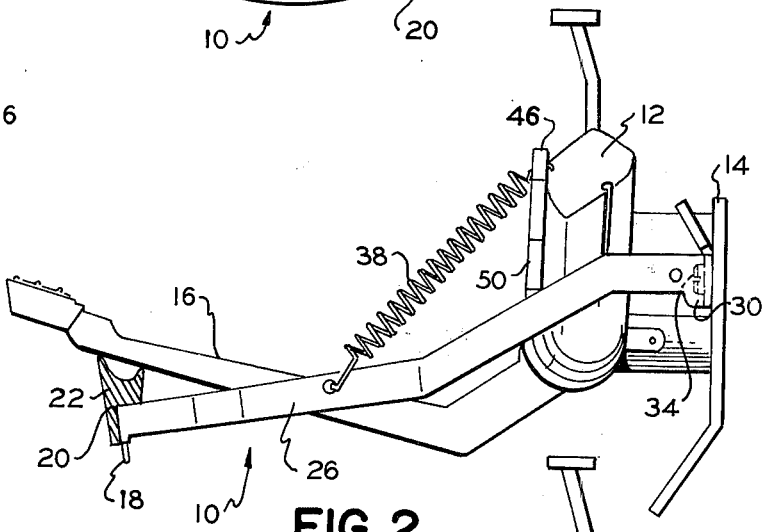
FIG. 2 is a right elevation view of the typebar support with all typebars at rest on the typebar support.

Typebar support 10 includes an arcuate member 18 spaced from and parallel to frame 14. Arcuate member 18 is of thin metal construction having an edge 20 oriented for typebar support. Edge 20 is covered by a pad 22 of resilient material. A pair of arms 24 and 26 extend from the ends of frame 14 to arcuate member 18. Arcuate member 18 is then suspended and spaced from segment 12 to provide support for the free ends of typebars 16. The ends of arms 24 and 26 that are attached to frame 14 terminate in lateral flanges 28 and 30. Flanges 28 and 30 are provided with an aperture 32 (FIG. 4). The walls defining the apertures 32 cooperate with a shoulder screw 34. A shank portion 36 of shoulder screw 34 extends through aperture 32 with sufficient clearance to allow a rockable motion of typebar support 10 on frame 14. A common point of mounting and rocking is defined by the cooperation of shoulder screws 34 and flanges 28 and 30.

Typebar support 10 is biased upwards by a pair of springs 38. One end of each spring 38 is attached to arms 24 and 26 and the other end attached to a pair of abutment members 44 and 46.

Abutment members 44 and 46 are fixed to segment 12 and include a pair of laterally extending abutment arms 48 and 50. Arms 48 and 50 provide an upper limit abutment for arms 24 and 26 of typebar support 10.

As a typing operation commences, a keylever (not shown) is depressed and through linkage (not shown) typebar 16 is placed in flight to impact a platen (not shown) and then return to rest. When a typebar is in-flight and returning to rest, it accumulates kinetic energy which must be dissipated and absorbed quickly and efficiently. Otherwise, the typebar may rebound into the flight path of the next typebar actuated and cause the typebars to collide.

Figure 3:
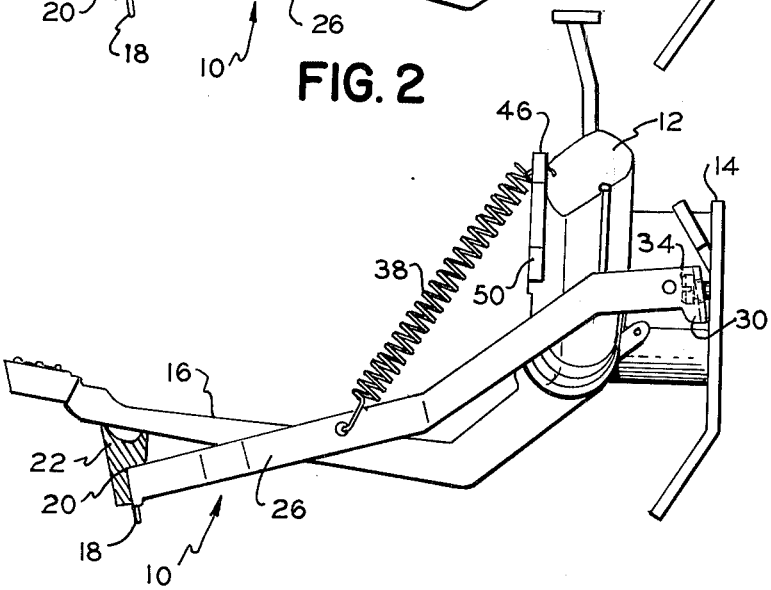
FIG. 3 is a right elevation view of the typebar support immediately after a typebar impacts the support.

When an in-flight typebar returns to rest on support 10, the energy of the initial impact of the typebar is partially absorbed by the resilient pad 22 covering support edge 20. The absorption of the energy is a result of the immediate portion of the pad struck by the typebar yielding under the force of impact. The remaining energy is dissipated as typebar support 10 is urged to rock about shoulder screws 34 as shown in FIGS. 3 and 4. If a typebar 16 on the right side of center of segment 12 is actuated and returns to rest, the energy at impact on support 10 will cause the right side of support 10 to rock about shoulder screw 34. Any excess energy thereafter will be dissipated through the remaining portion of typebar support 10. If a typebar 16 on the left side of center of segment 12 is actuated and returns to rest, the energy at impact on support 10 will cause the left side of support 10 to rock about shoulder screw 34. Any excess energy thereafter will be dissipated through the remaining portion of the typebar support 10. If a typebar 16 in the center area of segment 12 is actuated, and returns to rest, the energy at impact on typebar support 10 will cause the left and right sides of typebar support 10 to rock about shoulder screws 34.

Therefore, the absorption of the energy of the typebar 16 by resilient pad 20 and the dissipation of the excess energy by the rocking of typebar support 10 minimize any rebound of the typebars as they return to rest.

While the foregoing description has shown and described the fundamental novel features as applied to a preferred embodiment, it will be understood by those skilled in the art that modifications embodied in various forms may be made without departing from the spirit and scope of the invention.

What is claimed is:

1. In a typewriter having a frame, a typebar segment rigidly assembled to the frame, a plurality of typebars having one end pivotally anchored in the segment, and a yieldable support having a rest position for the free end of the typebars, the yieldable support comprising:

arcuate means spaced from the frame for supporting the free end of the typebars;

arm means having one end fixed to said arcuate means and having its opposite end defining an enlarged aperture therethrough;

retention means comprising a reduced cross sectional portion, and an enlarged cross sectional portion, said reduced portion extending through and beyond said aperture and into said frame with sufficient clearance between said reduced portion and said aperture to allow said arm means to rock relative to the frame and wherein said enlarged portion is secured to said reduced portion on the side of said aperture opposite said frame; and biasing means for dissipating energy of an impacting typebar and for urging said arm means toward the rest position of the free end of the typebars.

2. A typebar support as defined in claim 1 wherein said arcuate means includes a yieldable pad along its typebar receiving edge for yieldably supporting the free end of the typebars.

3. A typebar support as defined in claim 1 further comprising abutment means on the frame engaged by said arm means for defining the rest position of the free end of the typebars.

4. A typebar support as defined in claim 1 wherein said retention means is a shoulder screw extending through said aperture with sufficient clearance to allow said arm means to rock relative to the frame.

5. A typebar support as defined in claim 1 wherein said biasing means is a spring.

* * * * *